US008707526B2

(12) United States Patent
Cooke et al.

(10) Patent No.: US 8,707,526 B2
(45) Date of Patent: Apr. 29, 2014

(54) CONTAINER SYSTEM FOR STORING REMAINS

(75) Inventors: Derek Michael Cooke, Warren, NJ (US); Kevin Allen Cooke, Lafayette, NJ (US)

(73) Assignee: Orchard Hill Memorial Park, Inc., Lafayette, NJ (US)

( * ) Notice: Subject to any disclaimer, the term of this patent is extended or adjusted under 35 U.S.C. 154(b) by 0 days.

(21) Appl. No.: 13/586,645

(22) Filed: Aug. 15, 2012

(65) Prior Publication Data

US 2014/0047683 A1 Feb. 20, 2014

(51) Int. Cl.
*A61G 17/00* (2006.01)

(52) U.S. Cl.
USPC ..... 27/1; 40/722

(58) Field of Classification Search
USPC ..... 27/1, 35; 220/23.87, 23.89; D99/5; 211/85.27; 40/722, 725, 124.5
See application file for complete search history.

(56) References Cited

U.S. PATENT DOCUMENTS

| | | | | | |
|---|---|---|---|---|---|
| 3,529,730 | A * | 9/1970 | Thompson | 211/85.27 |
| 5,903,961 | A * | 5/1999 | Parker et al. | 27/1 |
| 6,023,822 | A * | 2/2000 | Luebke | 27/1 |
| 6,161,268 | A * | 12/2000 | Joseph | 27/35 |
| 6,167,600 | B1 * | 1/2001 | Williams et al. | 27/1 |
| 6,421,890 | B1 * | 7/2002 | Biggar | 27/1 |
| 6,944,921 | B1 * | 9/2005 | Gersten | 27/1 |
| 7,036,195 | B2 * | 5/2006 | Glass | 27/1 |
| 7,171,733 | B2 * | 2/2007 | Min | 27/35 |
| 7,406,754 | B2 * | 8/2008 | Trail | 27/1 |
| 7,475,457 | B1 * | 1/2009 | Gersten | 27/1 |
| 7,478,461 | B2 * | 1/2009 | Glass | 27/1 |
| 7,627,935 | B1 * | 12/2009 | Ostrum | 27/1 |
| 7,703,185 | B2 * | 4/2010 | Trail | 27/1 |
| 7,739,776 | B2 * | 6/2010 | Hume | 27/35 |
| 8,046,881 | B2 * | 11/2011 | Johnson et al. | 27/1 |
| 8,074,329 | B2 * | 12/2011 | Roberts | 27/1 |
| 8,146,216 | B2 * | 4/2012 | Creager | 27/1 |
| 8,286,314 | B1 * | 10/2012 | Muthusami | 27/1 |
| 2002/0100152 | A1 * | 8/2002 | Ortega | 27/1 |
| 2010/0101062 | A1 * | 4/2010 | Chen et al. | 27/1 |
| 2010/0101063 | A1 * | 4/2010 | Chen et al. | 27/1 |

OTHER PUBLICATIONS http://www.perfectmemorials.com//product_images/737328/lg/3826.mediuumrotating . . . ; printed Oct. 4, 2011.

* cited by examiner

*Primary Examiner* — William Miller
(74) *Attorney, Agent, or Firm* — K&L Gates LLP

(57) ABSTRACT

A container system for storing remains is provided, including a rigid storage vessel defining an inner chamber for receiving remains. The system includes at least one display frame member outside the rigid storage vessel for displaying information, such as a picture. A cap is provided proximate the storage vessel, wherein the cap defines at least one storage area for receiving an object.

16 Claims, 10 Drawing Sheets

CONTAINER SYSTEM FOR STORING REMAINS

FIELD OF THE INVENTION

The present invention relates to a container system for storing remains, and more particularly to a container system for storing the remains of a pet or other animal.

BACKGROUND OF THE INVENTION

As the number of household pets increases, there exists a growing problem as to disposition of the pet remains. A pet owner has to determine how best to dispose of the remains when the pet dies given that residential pet burial is increasingly becoming illegal in more and more counties and states. Local landfills are often used as the only option for disposing of pet remains. For many pet owners, this option does not preserve the memory of the pet or respect for the pet's body once deceased. Accordingly, many veterinarians offer cremation as an option for pet owners. Some veterinarians have in-house crematories, while independent crematories are becoming more and more popular. A pet owner who selects cremation for his or her pet receives the pet's ashes after the cremation process. Alternatively, the pet owner may select non-return of the pet's ashes, whereby the crematory will cremate several animals at once and dispose of the ashes.

If the pet owner selects to have the pet's ashes returned, the ashes are typically returned in a plastic bag to the pet owner. For an additional fee, the pet owner may purchase a decorative urn that can be displayed in the pet owner's home that stores the bag of ashes. Many different types of urns of various sizes, shapes, materials and decorative features, such as pre-printed or hand written poems about the deceased pet, photographs and various other items and decorations are available in the market place. The urns are typically lined in a soft material, such as felt or suede, and include a sliding or hinged top for enclosing the plastic bag of ashes therein. However, there are shortcomings associated with such urns.

Such urns do not sufficiently secure the plastic bag of ashes, particularly if the urn is dropped or suddenly moved, which could lead to the plastic bag rupturing and spilling the ashes inside the urn and potentially spilling outside the urn. In addition, the plastic bag of ashes is also visually distasteful to a pet owner, who would rather have possession of the ashes but not be forced to view the ashes in a loose plastic bag. Accordingly, there is a need for a pet urn or container system that securely stores the ashes of a pet or other animal safely and efficiently, but does so in a way that is visually pleasing to the pet owner and provides a respectful presentation of the deceased pet. These and other needs are addressed by the container system of the present invention.

SUMMARY OF THE INVENTION

The present invention provides a container system for storing remains or ashes of an animal, such as a pet. The container system comprises a base having at least three sides, a rigid storage vessel defining an inner chamber for receiving animal remains, a housing adapted for receiving the storage vessel that is connected to the base, and at least one display window for displaying information such as a certificate of cremation, images or other mementos of the deceased pet or animal. The storage vessel comprises a cap for sealing the remains inside the storage vessel. The container system further comprises a top cap that can be removably attached to the housing, thus creating a pleasing visual presentation of the deceased animal while securely storing the remains inside. The top cap optionally comprises a compartment or a storage area for receiving and containing a special memento of the pet such as a metal tag, note, photo, or other special remembrance. The storage area inside the top cap is hidden underneath the top cap for use as a special location for the pet owner.

A side or sides of the housing further comprises a picture frame or other window or display area that is sized to receive custom imagery and messages about the deceased animal. These windows or display areas are optionally filled by the pet owner with materials, such as meaningful tributes, information, and keepsakes of the deceased animal. As a preferred feature of the container system, at least one of the display frames is adapted for displaying digital images. An audio system is also optionally provided for playing a sound recording.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments and advantages of the container system of the present invention will become apparent from the following detailed description with reference to the drawings, wherein.

DETAILED DESCRIPTION OF THE INVENTION

In the following written description of the present invention, it will be readily understood by those persons skilled in the art that the present invention is susceptible of broad utility and application. Many embodiments and adaptations of the present invention other than those herein described as well as many variations, modifications and equivalent arrangements, will be apparent from or reasonably suggested by the present invention in the foregoing description hereof without departing from the substance or scope of the present invention. Accordingly, while the present invention is described here in detail, it is to be understood that this disclosure is only illustrative and exemplary of the present invention and is made merely for purposes of providing a full and enabling disclosure of the invention. The foregoing disclosure is not intended nor is it to be construed to limit the present invention or otherwise to exclude any such other embodiments, adaptations or variations, modifications and equivalent arrangements.

The present invention provides a unique and advantageous container system or pet urn for storing remains of a deceased pet or other animal. The container system of the present invention is to be used by a pet owner for storage of the remains of a pet, and may be purchased by the pet owner or provided by a veterinarian or crematory as a service offering or option during the cremation process. The container system of the present invention provides a pet owner with secure storage of the remains of a pet in a pleasing display that is customizable by a pet owner for perpetual enjoyment and for respecting the memory of the deceased pet.

Figure 1:
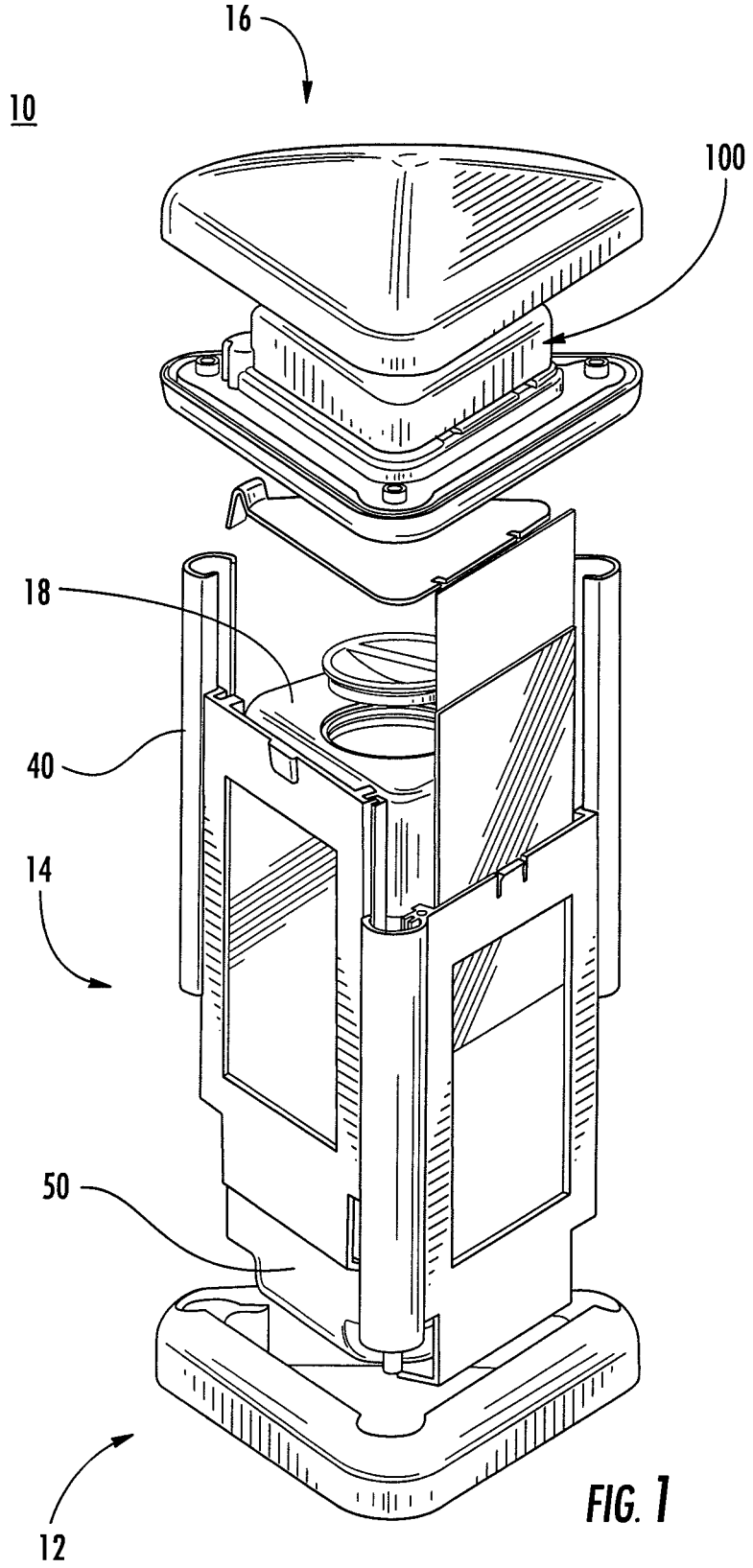
FIG. 1 shows an exploded perspective view of a container system according to the present invention.

Referring now to the drawings, a container system for storing remains in accordance with the present invention is shown in FIG. 1. A container 10 comprises a base 12, body 14, and cap 16. A rigid storage vessel known as a bladder 18 is disposed within the body 14 and proximate the base 12 for receiving a substance, such as cremated remains from a pet, animal or the like. An inner container 50 is disposed proximate the bladder 18 and connected to the base 12. A compartment 100 suitable for a memento is positioned below the or beneath the cap 16.

Figure 2:
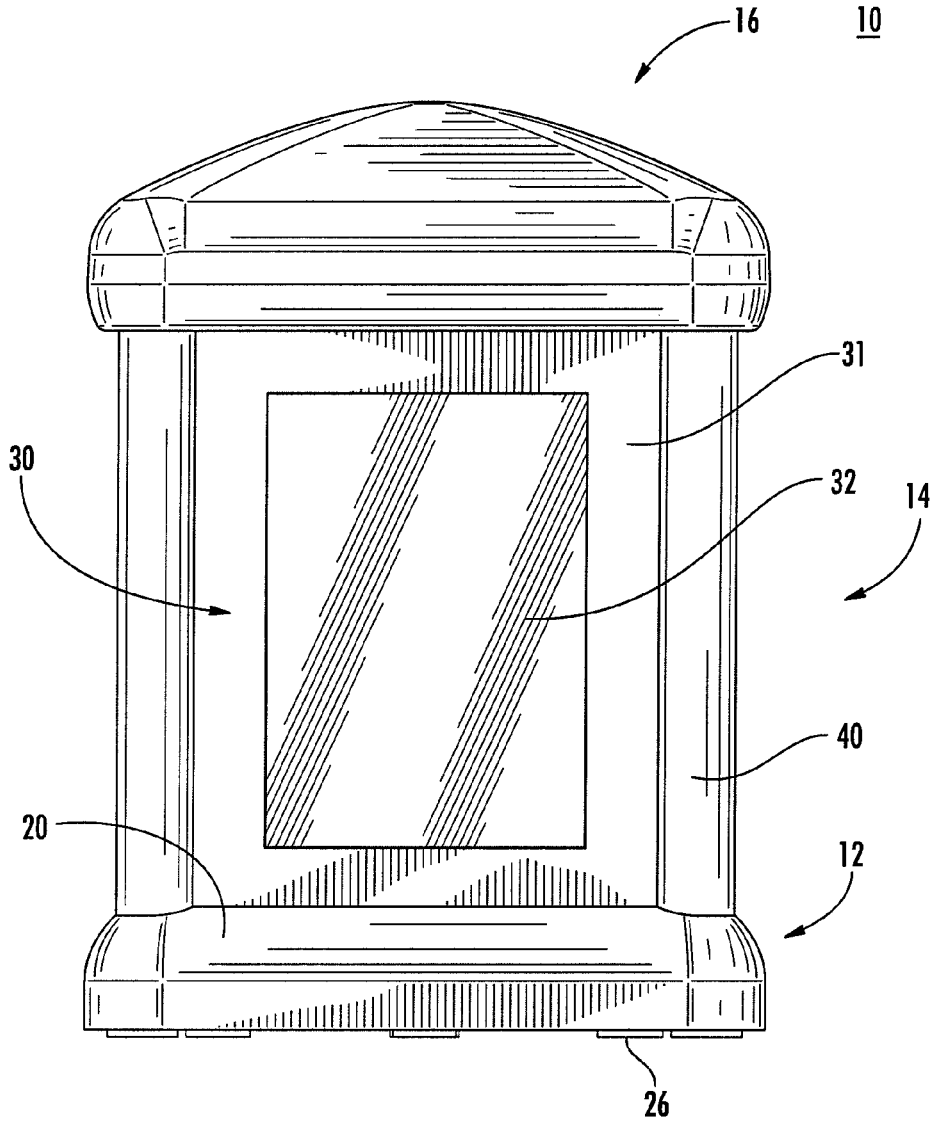
FIG. 2 shows an elevation view of the container of FIG. 1.
Figure 3A:
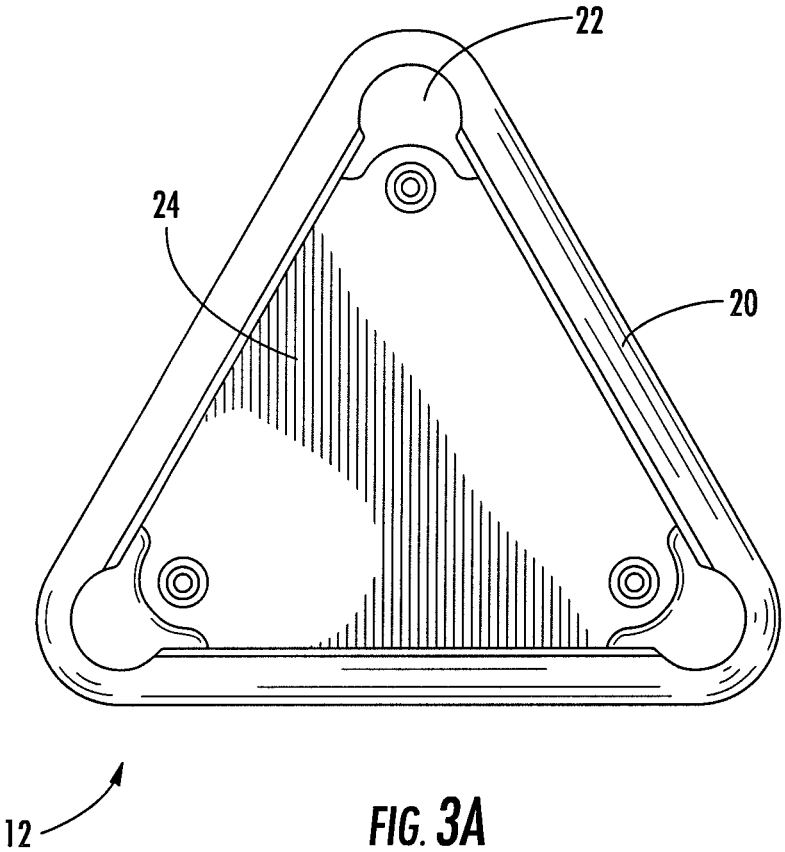
FIG. 3A & FIG. 3B show plan and elevation views of a base of the container system of FIG. 1.
Figure 3B:
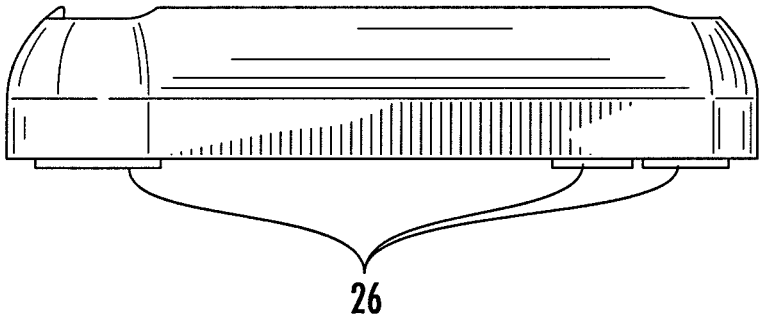

Referring now to FIG. 2 and FIGS. 3A and 3B, the container 10 comprises at least three sides, wherein each side includes a frame member 30 having an outer surface 31 that defines a window 32 or other opening for displaying information, such as but without limitation, a certificate of cremation, photograph(s), poems or other writing. The window 32 optionally includes a clear piece of plastic or glass for protecting the information displayed in the window. The frame member 30 is connected to the base 12 and secured to an adjacent frame by a corner cap 40. Additional methods are alternatively employed to secure the frame member 30, such as gluing, hinging, or making or forming integral with the base 12.

As shown in FIGS. 3A and 3B, the base 12 employs the same or similar shape as the combined frame members 30 and defines an outer surface 20 that can be rounded, curved, or otherwise prepared such that the base has a decorative appearance. As shown in FIGS. 3A and 3B, the base 12 has at least three sides and one or more grippers 26, such as thin rubber or felt pad(s) that serve as cushioned feet to protect the bottom of the container 10 and the surface upon which it sits. As shown in FIG. 3A, the base 12 defines a plurality of recessions 22 that are designed and sized to receive the corner caps 40 (shown in FIG. 2) to assist in securing the frame member 30 to the base 12. As shown in FIG. 3A, a cavity 24 is defined for receiving the frame member 30 such that the frame is placed into the cavity 24. The side wall of the cavity 24 provides additional support for the frame member 30 and provides for a clean appearance to the container 10.

Figures 4A, 4B:
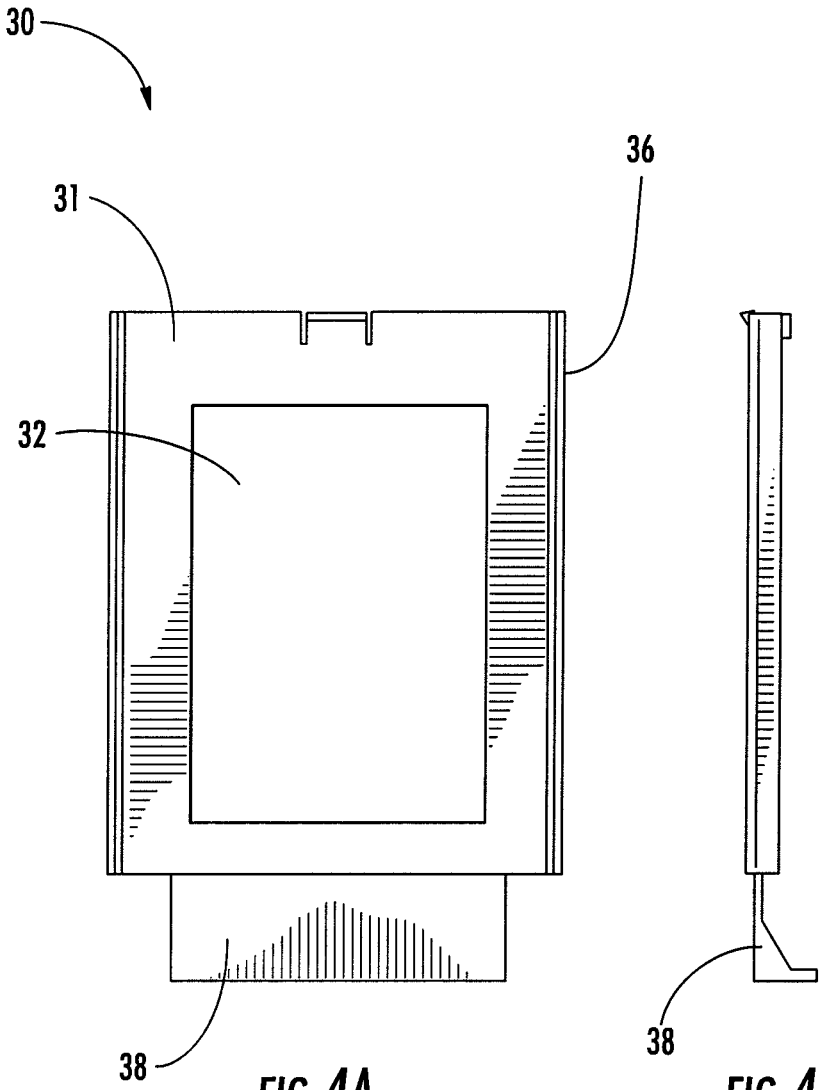
FIG. 4A & FIG. 4B show plan and elevation views of a frame of the container system of FIG. 1.

FIGS. 4A and 4B show elevation views of the frame member 30. In one embodiment, the frame member 30 includes three sections that combine into a triangular shape. However, it is within the scope of the present invention that other shapes are possible, such as a four sided container (i.e., square), five sided container (i.e., pentagon), or other polygonal shape. The frame member 30 has an outer surface 31 that defines an opening or window 32. As a feature of the container, the window 32 predominantly occupies the area of the outer surface, preferably an area of at least half the area of the surface 31. The window 32 is preferably rectangular and sized in proportion to the overall size of the container 10, although many other shapes and sizes are contemplated by the present invention, such as circular, oval, and polygonal. The frame member 30, and in at least one example window 32, is capable of receiving and displaying information, such as photographs, printed documents, digital images and information, and mementos. The frame member 30 includes edges 36 on each side that are designed to interact with corner cap 40. The edges 36 have ridges that interact with and create an interference or frictional fit with the corner cap 40 to secure the frame member 30 to the corner cap 40. The frame member 30 also includes a tab 38 that extends downwardly towards the base 12 and into the cavity 24 shown in FIG. 3A.

Figure 5B:
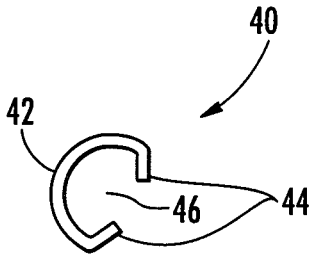
FIG. 5A & FIG. 5B show plan and elevation views of a corner cap of the container system of FIG. 1.
Figure 5A:
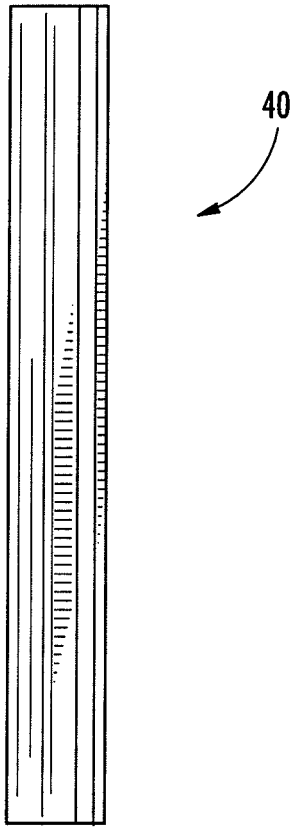

FIGS. 5A and 5B show elevation and plan views of the corner cap 40. The corner cap 40 comprises a cap body 42 shown in FIG. 5B that is substantially the length of the frame member 30 and generally forms a "C" shape with ends 44 that define an opening 46. As mentioned above, an edge 36 of the frame member 30 engages and ends 44 of the corner cap 40 to secure the frame member 30 to the corner cap 40. In particular, two frame members 30 engage one corner cap 40 whereby the ends 44 of the cap body 42 are spread apart and around the edges 36 of each frame member 30. Once an interference fit is created between the edges 36 of the frame member 30 and ends 44 of the corner cap, the corner cap is slidable or moveable down the length of the frame member 30 to operably secure the frame members together. In order to accommodate the interference fit and movement when securing the frame members 30, the corner cap 40 is preferably an elastically deformable material such as plastic or other flexible material.

Figure 6A:
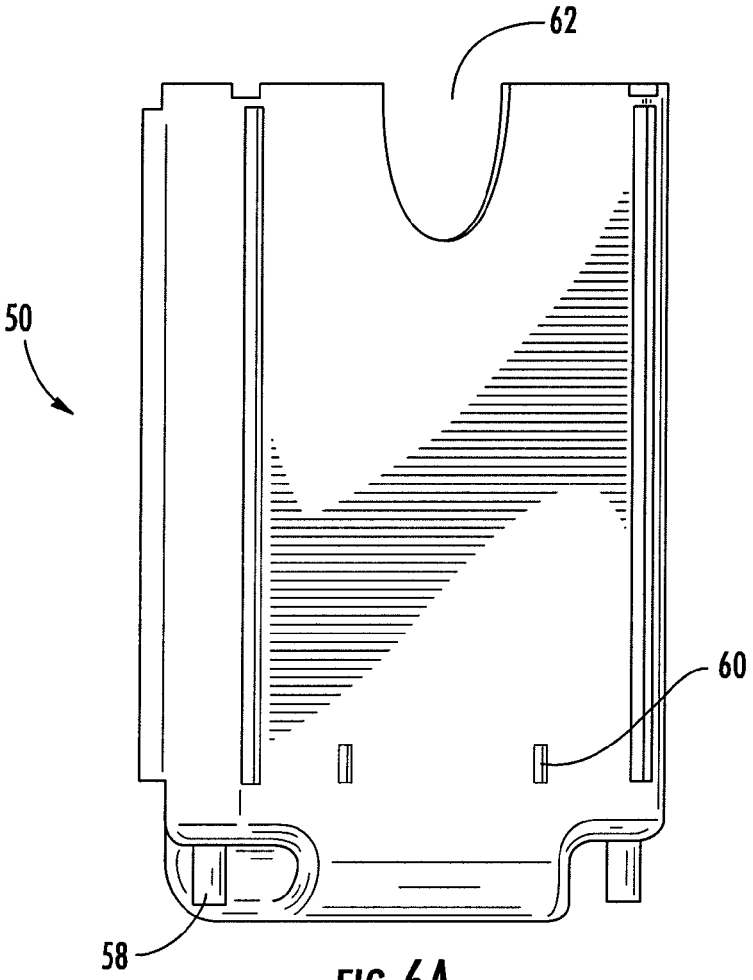
FIG. 6A & FIG. 6B show plan and elevation views of an inner container of the container system of FIG. 1.
Figure 6B:
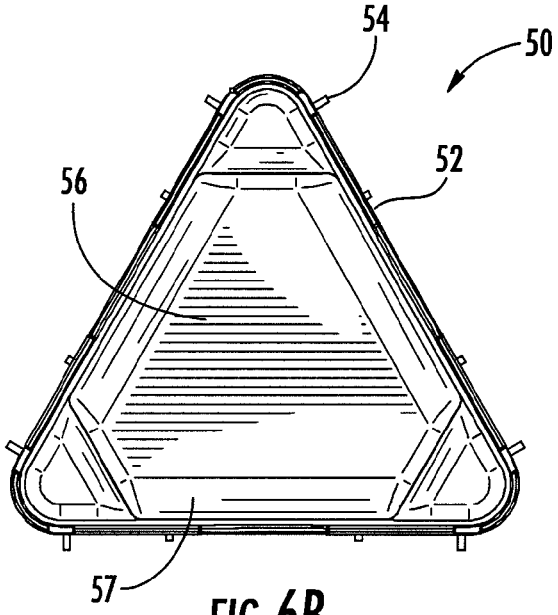

FIGS. 6A and 6B show plan and elevation views of the inner container 50 that is disposed inside the frame 30. The inner container 50 has sides 52 defining a cavity 56 and tabs 54 extending therefrom. At an end of the inner container 50, the sides 52 extend inwardly to form a base edge 57. The base edge 57 is positioned closest to the base 12. A pair of protruding picture stops 60 extends from each side 52 that is designated to coordinate with the window 32. The side 52 also defines a recession 62 to facilitate the removal of a picture or other display item. As another feature, support tabs 58 extend downwardly towards the base 12 and are sized to be received by the recessions 22 and the base 12 (see FIGS. 3A and 3B).

Figure 7A:
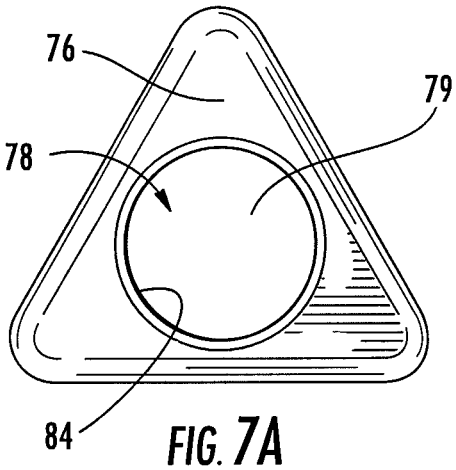
FIG. 7A & FIG. 7B show plan and elevation views of a bladder of the container system of FIG. 1.
Figure 7B:
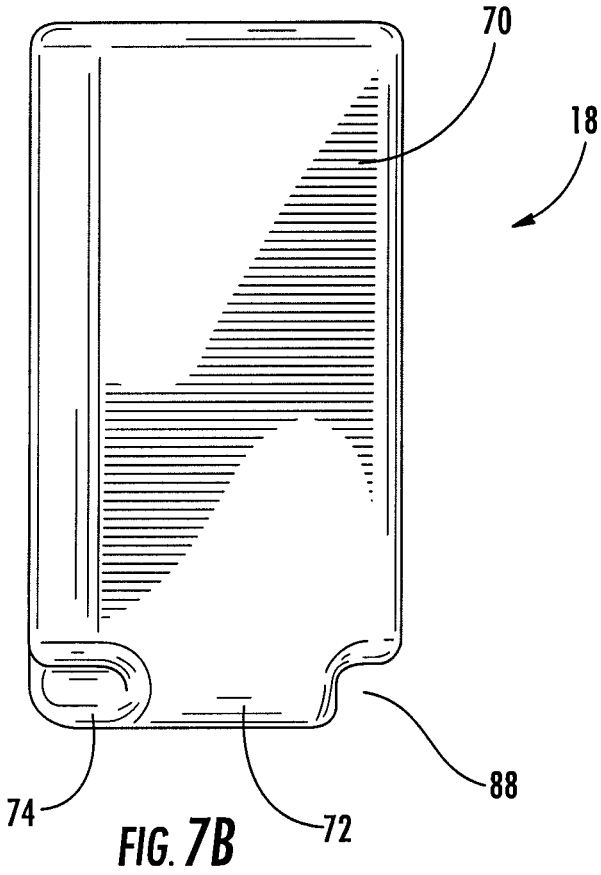
Figure 7C:
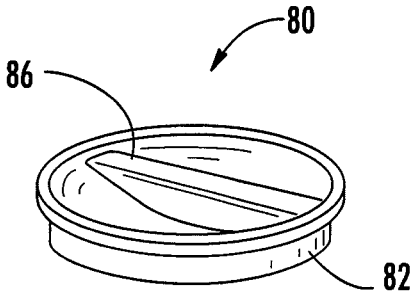
FIG. 7C shows a perspective view of a closure for the bladder of FIGS. 7A and 7B.

FIGS. 7A and 7B show the rigid storage vessel or bladder 18 that comprises a body 70 having a base 72. A top surface 76 defines an opening 78 with threads 84 for receiving a closure 80 shown in FIG. 7C having mating threads 82 and a tab 86 or other structure for assisting the on/off movement of the closure to the bladder 18. The opening 78 shown in FIG. 7A defines an inner chamber or cavity 79 for receiving the cremated remains of the pet or animal. The volume of the inner chamber or cavity 79 is dependent upon the size and shape of the bladder 18, but preferably is sized to hold at least one animal. The body 70 includes a radius edge 88 and edge 74 for proper seating inside the inner container 50. The bladder 18 is preferably made from a rigid or semi-rigid polymeric material, such as high-density polyethylene (HDPE), but other rigid or semi-rigid material(s), such as glass, films and fibers are also suitable.

Figure 8A:
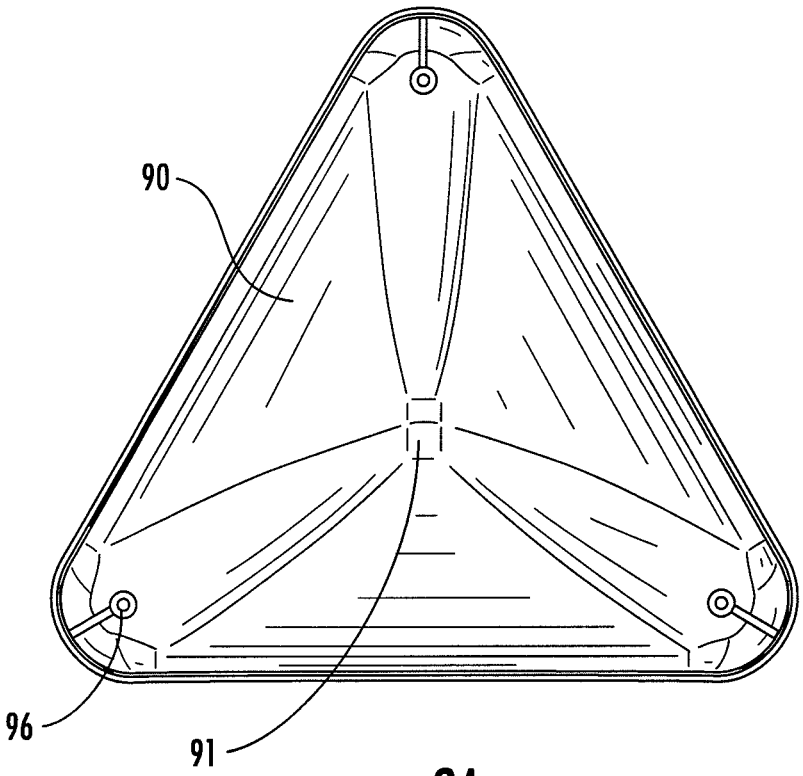
FIG. 8A & FIG. 8B show plan and elevation views of a cap of the container system of FIG. 1.
Figure 8B:
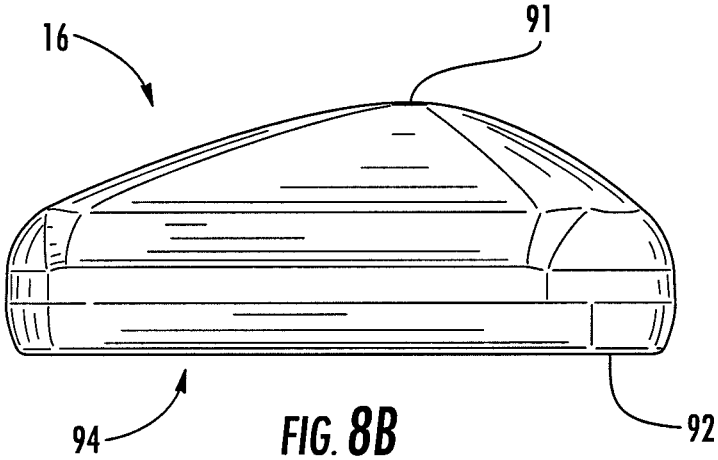

FIGS. 8A and 8B show a representative cap 16. The cap 16 comprises a cap outer surface 90 having a peak 91 that provides a decorative appearance and includes a lower edge 92. The outer surface 90 may also define a display area for displaying information, such as a photo, written message, or graphic. The cap 16 defines a cavity 94 that is sized for receiving an object as described below. A plurality of openings 96 are defined for securing the cap 16 to the frame 30 or other element of the container 10. It should be noted that while one peak 91 is shown, multiple peaks or no peaks are also be contemplated by the present invention.

Figure 9A:
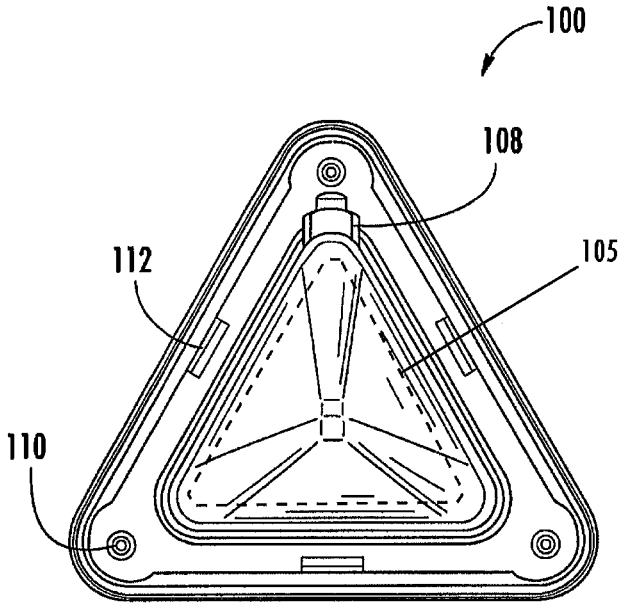
FIG. 9A & FIG. 9B show plan and elevation views a memento compartment of the container system of FIG. 1.
Figure 9B:
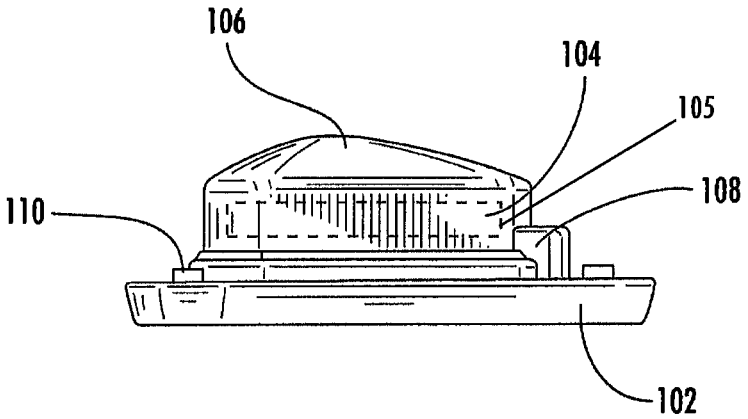

FIGS. 9A and 9B show a memento compartment 100 that is sized to fit between the cap 16 and the bladder 18 and designed to receive one or more personalized mementos of the deceased pet or animal, such as dog tag, hair strands, portion of a leash, or other such object. As shown in FIG. 9B, the memento compartment 100 includes a base 102 and body 104 extending therefrom. The body 104 includes a peak 106 that is sized and located to correspond with the peak 91 of the cap 16. As shown, the body 104 is hollow and defines a cavity (not shown) that is substantially equal in volume to the overall volume of the body 104. Accordingly, a memento can be placed in the cavity of the body 104 and disposed between the body and the base 102. As a feature, a tab 108 is provided for releasing the body 104 from the base 102 (see FIG. 9A). A plurality of tabs 110 are positioned and extend from the base 102. The tabs are designed to engage the openings 96 of the cap 16. A separate tab 112 is also provided. The tab 112 acts as a female "catch" and is molded into the compartment 100. The tab 112 receives a corresponding male "snap lock" (not shown) that is molded into the top edge of the frame. The tab 112 and male snap lock act as a mechanism to secure the top of the base 12 and frame member 30.

Figure 10A:
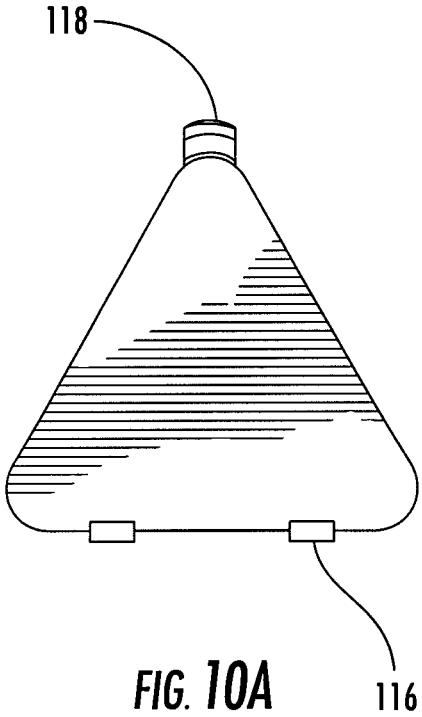
FIG. 10A & FIG. 10B show plan and elevation views of a battery door of the memento compartment of FIG. 9.
Figure 10B:
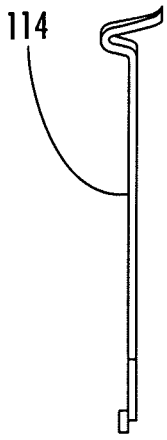

FIGS. 10A and 10B show a cover 114 that is positioned on the memento compartment 100 opposite the body 104 (see FIGS. 9A and 9B). The cover 114 includes tabs 116 and 118 for securing one or more items within a compartment (not shown) defined by the memento compartment 100. As such, the memento compartment 100 may also include other types of objects within the body 104 of the memento compartment. For example, an audio device or system 105 capable of producing sound is optionally located within the cavity defined by the body 104 for generating sound effects or recordings such as music or other audio. Batteries, if needed, are placed in a compartment defined by the memento compartment 100 and held in place by cover 114. With reference to FIG. 2, batteries may also be necessary or desired if the frame 30 and window 32 include digital display screens for displaying one or more digital images of a pet or conveying relevant information. The container 10 is optionally electronically powered to be plugged into a standard wall outlet as an alternative to batteries.

In operation and with reference to FIG. 1, the ashes of a deceased pet or animal are placed within the storage vessel or bladder 18 and secured by the closure 80. The pet owner further selects other information to be placed in the window 32 of each frame member 30 as described herein. A special memento is optionally placed within the memento compartment 100 and covered with cap 16. The ashes are thus secured and contained within a robust and decorative bladder and container such that the ashes do not rupture the bladder if the container 10 is knocked over or dropped. The body 14 is used to enhance the memory and goodwill between the pet owner and pet, and the veterinarian and pet owner. Accordingly, the container 10 of the present invention: (1) effectively contains the cremated remains using a separate, internal containment bladder; (2) provides for high visibility of information, such as a formal certificate of cremation, decedent ID, service provider ID, and date of service; and (3) presents a memorial image or images of the pet, either by still photograph or digital.

Many modifications and other embodiments of the invention will come to mind to one skilled in the art to which this invention pertains having the benefit of the teachings presented in the foregoing description and the associated drawings. For example, the inner housing container 50 may not be a separate element or even be included at all, or may be integrated as one element with the base 12 and/or frame members 30. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A cremation remains container system for storing remains of a deceased, comprising:

a base having three sides and a plurality of recessions;

an inner container defining a cavity and connected to the base;

a rigid storage vessel positioned in the cavity defined by the inner container, the rigid storage vessel defining an inner chamber for receiving the remains;

a threaded closure for assisting with the on and off movement of the closure to the rigid storage vessel, at least one corner cap for insertion in the recessions of the base; and a frame member positioned outside the inner container for displaying information and having a tab that extends downwardly into the base and secured to an adjacent frame member by the corner cap.

2. The cremation remains container system of claim 1, further comprising a cap adapted to be removably attached to said inner container.

3. The cremation remains container system of claim 2, wherein said cap defines a display area for displaying information has a hidden storage area.

4. The cremation remains container system of claim 1, wherein the information is selected from the group consisting of photographs, printed documents, and mementos.

5. The cremation remains container system of claim 2, wherein the cremation remains container system further comprises a covered momento compartment located between the cap and the rigid storage vessel.

6. The cremation remains container system of claim 5, wherein the covered momento compartment has a momento compartment base and a momento compartment body.

7. The cremation remains container system of claim 6, wherein the container system further comprises an audio system in the momento compartment body of the momento compartment for playing a sound recording.

8. The cremation remains container system of claim 1, wherein the information is in a form of a digital images.

9. The cremation remains container system of claim 1, wherein the storage vessel is removably secured within said inner container.

10. A cremation remains container system for storing remains of a deceased, comprising:

a base having three sides;

a rigid storage vessel defining an inner chamber for receiving the remains;

a housing adapted for receiving the storage vessel that is connected to the base;

at least one frame member positioned outside the rigid storage vessel;

a threaded closure for assisting with the on and off movement of the closure to the the inner chamber of said storage vessel; and a cap operably connected to the at least one frame member at an end of said storage vessel, a covered memento compartment located between the cap and the rigid storage vessel, wherein the covered memento compartment has a memento compartment base and a memento compartment body.

11. The cremation remains container system of claim 10, wherein said at least one frame member is adapted for receiving information selected from the group consisting of photographs, printed documents, and mementos.

12. The cremation remains container system of claim 11, wherein the information is in a form of a digital image.

13. The cremation remains container system of claim 12, wherein the container system further comprises an audio system in the momento compartment body of the momento compartment for playing a sound recording.

14. A cremation remains container system for storing remains of a deceased, comprising:

a base having three sides and a plurality of recessions;

a rigid storage vessel positioned proximate the base and defining an inner chamber for receiving the remains;

a three-sided housing connected to the base for receiving the storage vessel;

a threaded closure for assisting with the on and off movement of the closure to the rigid storage vessel;

a frame member having a tab that extends downwardly into the base and secured to an adjacent frame member by a corner cap;

wherein the corner cap is received by the plurality of recessions to secure the frame member to the base.

15. The cremation remains container system of claim 14, wherein the frame member has an outer surface comprising at least one window for displaying information.

16. The cremation remains container system of claim 14, wherein the rigid storage vessel comprises HDPE.

* * * * *